US010767323B2

(12) United States Patent
Connell et al.

(10) Patent No.: US 10,767,323 B2
(45) Date of Patent: Sep. 8, 2020

(54) LIFTING OF CONCRETE COMPONENTS

(71) Applicant: Illinois Tool Works Inc., Glenview, IL (US)

(72) Inventors: Robert Urquhart Connell, Melbourne (AU); Andrew Saul Barraclough, Langwarrin (AU); Alexander Charles Knott, Melbourne (AU)

(73) Assignee: Illinois Tool Works Inc., Glenview, IL (US)

( * ) Notice: Subject to any disclaimer, the term of this patent is extended or adjusted under 35 U.S.C. 154(b) by 350 days.

(21) Appl. No.: 15/502,357

(22) PCT Filed: Aug. 6, 2015

(86) PCT No.: PCT/US2015/044019
§ 371 (c)(1),
(2) Date: Feb. 7, 2017

(87) PCT Pub. No.: WO2016/032718
PCT Pub. Date: Mar. 3, 2016

(65) Prior Publication Data

US 2017/0226702 A1 Aug. 10, 2017

(30) Foreign Application Priority Data

Aug. 29, 2014 (AU) ..... 2014903443

(51) Int. Cl.
*B66C 1/66* (2006.01)
*E01C 23/10* (2006.01)
(Continued)

(52) U.S. Cl.
CPC ..... *E01C 23/10* (2013.01); *B66C 1/666* (2013.01); *E01C 11/005* (2013.01);
(Continued)

(58) Field of Classification Search
CPC ..... B66C 1/666; E01C 23/10; E01C 11/005; E04B 1/35; E04B 2001/3588; E04G 21/142
(Continued)

(56) References Cited

U.S. PATENT DOCUMENTS 3,333,388 A 8/1967 Sandin
3,431,012 A 3/1969 Courtois et al.
(Continued)

FOREIGN PATENT DOCUMENTS

AU 755585 11/1999
AU 2002320664 4/2003
(Continued)

*Primary Examiner* — Michael Safavi
(74) *Attorney, Agent, or Firm* — Neal, Gerber & Eisenberg LLP

(57) ABSTRACT

A lifting system for a concrete component comprises a void former incorporated into the component during casting and which provides within the component a void which receives a locking pin of a lifting anchor assembly which is locked within the void by rotation of a locking pin. The lifting anchor assembly has a visual indicator to indicate when the pin is in its locked condition within the void, and a pivotal lifting shackle of the assembly is prevented from movement into a position in which lifting can take place until the pin is in its locked condition. Preferably a base of the void former is configured to retain components of a jacking system by which a concrete slab used for road repair can be jacked into a level configuration with the remainder of the roadway when it has been positioned by use of the lifting system.

13 Claims, 5 Drawing Sheets

(51) Int. Cl.
*E04G 21/14* (2006.01)
*E04B 1/35* (2006.01)
*E01C 11/00* (2006.01)

(52) U.S. Cl.
CPC ..... *E04G 21/142* (2013.01); *E04B 1/35* (2013.01); *E04B 2001/3588* (2013.01)

(58) Field of Classification Search
USPC ..... 294/82.33; 52/124.2, 125.1, 125.4, 125.5
See application file for complete search history.

(56) References Cited

U.S. PATENT DOCUMENTS 4,017,115 A * 4/1977 Holt ..... B66C 1/666 294/86.4
4,068,879 A 1/1978 Torbet et al.
4,179,151 A * 12/1979 Tye ..... E04G 21/142 294/89
4,325,575 A * 4/1982 Holt ..... B66C 1/666 294/89
RE31,131 E 1/1983 Torbet et al.
4,570,987 A 2/1986 Wong et al.
4,726,561 A * 2/1988 Worzala, Jr. ..... B28B 23/0056 249/219.1
4,785,593 A 11/1988 Munoz, Jr.
4,996,804 A 3/1991 Naka et al.
5,261,198 A 11/1993 McMillian
6,568,730 B1 5/2003 Paterson
6,694,680 B2 * 2/2004 Zambelli ..... E04G 21/142 294/89
6,792,734 B2 * 9/2004 Zambelli ..... B28B 23/005 52/125.1
7,213,795 B2 5/2007 Paterson
8,230,931 B2 * 7/2012 Rodriguez ..... B66C 1/66 166/377
8,640,399 B2 * 2/2014 Fradera Pellicer ..... B28B 5/04 52/125.1
8,875,471 B2 * 11/2014 Siqueiros ..... E01C 23/10 52/125.5
8,943,777 B2 * 2/2015 Espinosa ..... E02D 35/00 52/699
8,966,833 B2 * 3/2015 Ally ..... E04B 1/41 52/122.1
9,222,251 B2 * 12/2015 Espinosa ..... E04B 1/4121
9,347,232 B1 * 5/2016 Francies, III ..... E04G 21/142
RE46,831 E * 5/2018 Francies, III
2006/0248814 A1 11/2006 Chen et al.
2011/0041449 A1 * 2/2011 Espinosa ..... E02D 35/00 52/698
2014/0026515 A1 1/2014 Espinosa
2014/0053475 A1 2/2014 Baltazar
2015/0096242 A1 * 4/2015 Lin ..... E04G 15/04 52/125.5
2015/0167260 A1 6/2015 Siqueiros
2015/0284967 A1 * 10/2015 Kim ..... E04C 5/12 52/125.4

FOREIGN PATENT DOCUMENTS

DE 7244545 5/1973
DE 2264431 4/1974
DE 10 2010 019833 11/2011
EP 0565429 10/1993
EP 1 115 642 7/2001
EP 1 217 147 6/2002
WO WO 2014/025760 2/2014
WO WO-2014031365 A1 * 2/2014 ..... E01C 23/10

* cited by examiner

LIFTING OF CONCRETE COMPONENTS

PRIORITY CLAIM

This patent application is a national stage entry of PCT Application No. PCT/AU2015/044019, which was filed on Aug. 6, 2015, which claims priority to and the benefit of Australian Patent Application No. 2014903443, which was filed on Aug. 29, 2014, the entire contents of each of which are incorporated herein by reference.

FIELD

The present invention relates to a lifting system for concrete components and more particularly to a lifting anchor for quick release from the component.

BACKGROUND

One commonly used technique for repairing damage to roadways constructed of poured concrete is to cut out the damaged section and to replace it with a precast panel of the same dimensions. Usually the panel will be cast offsite, trucked to the site and then lifted into position. Typically the panel, which may weigh several tons, is lifted by the use of lifting anchors screwed into threaded inserts cast into the panel during its manufacture. Conventionally, the threaded inserts are in the form of internally-threaded collars which, after casting, open onto the upper face of the panel to receive the lifting anchors. For the several separate lifting operations likely to be involved between casting and laying of the slab in position, and likely involving storage of several panels in stacked relation and transportation of several panels in stacked relation, the lifting anchors will usually be required to be installed and removed several times. This can be quite a time-consuming and laborious operation as the thread length on the insert and which corresponds to the thread length of a threaded stem of the anchor runs for almost the full thickness of the panel.

At their lower ends the threaded inserts, although open, abut against a metal jacking plate, one for each insert, set into the underside of the panel during casting. After laying of the panel in position and removal of the lifting anchors, jacking rods are screwed into the inserts to engage the jacking plates which are in contact with compacted ground beneath the panel, in order to raise the panel so that it is set level with the surrounding roadway. During manufacture of the panel, grout holes are cast through the thickness of the panel at different locations over the surface of the panel and when the panel has been jacked into a position in which it is level with the surrounding roadway, concrete grout is injected through the grout holes to the underside of the panel in order to fill the void between the underside of the panel and the underlying ground surface. The jacking rods are removed from the threaded inserts after the grout has cured sufficiently to support the weight of the panel. As with the lifting anchors, because threaded engagement between the jacking rods and inserts occurs over a substantial thread length, it is a time-consuming and laborious operation to insert and remove the jacking rods.

Accordingly, there is a need to solve these problems.

SUMMARY

The present disclosure in one aspect provides a lifting system which enables quick insertion and release of lifting anchors into a panel such as a repair panel discussed above, and also quick insertion and release of subsequent jacking rods.

According to the present disclosure there is provided a lifting system for a concrete component, comprising a void former for incorporation into the component during casting thereof, the void former providing a passage to receive a locking stem of a lifting anchor assembly following casting, the void former providing a void within the component shaped for locking engagement with a locking pin of the locking stem by rotation of the pin following insertion whereby to lock the locking stem within the void to permit lifting load to be applied, the void former also including a jacking plate and associated threaded structure for receiving a threaded jacking rod inserted through the void former after removal of the lifting anchor assembly to permit jacking of the component from underlying structure.

Although the lifting system of the present disclosure has particular utility in conjunction with a jacking system for use with roadway repair panels, the lifting system by virtue of its quick insertion and release characteristics also has utility in other aspects of concrete lifting of components where jacking is not required.

Accordingly another aspect of the present disclosure provides a lifting system for a concrete component, comprising a void former for incorporation into the component during casting thereof, the void former providing a passage to receive a locking stem of a lifting anchor assembly following casting, the void former providing a void within the component shaped for locking engagement with a locking pin of the locking stem by rotation of the pin following insertion whereby to lock the stem within the void to permit lifting load to be applied, wherein the locking pin includes at least one locking lug movable into a locking condition within the void former upon rotation of the pin, the locking stem also including fixed structure located within the void former and engageable with the lug by axial displacement of the pin in order to provide a positive lock against rotation of the pin out of its locking condition.

The present disclosure also provides a void former configured for use in lifting systems as defined above.

BRIEF DESCRIPTION OF THE DRAWINGS

An embodiment of the present disclosure will now be described by way of example only with reference to the accompanying drawings in which.

DETAILED DESCRIPTION

Figure 1:
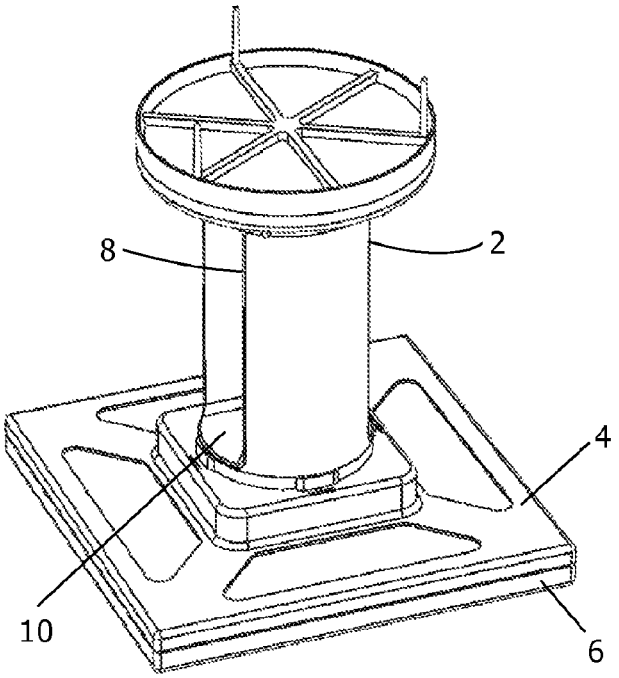
FIG. 1 shows a void former assembly of a lifting system in accordance with the one example embodiment of the present disclosure.
Figure 2:
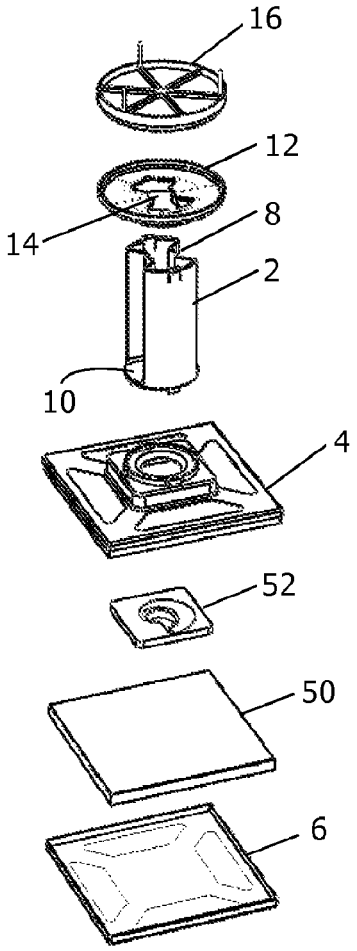
FIG. 2 shows the individual components of the void former assembly in exploded form.

With initial reference to FIGS. 1 and 2 the quick release lifting system of the illustrated example embodiment of the present disclosure comprises a void former assembly comprising a tubular main body 2 coupled at its lower end with a base formed by upper and lower shallow shells 4 and 6 of rectangular form for housing components of a jacking system used to subsequently level a panel as discussed above. The tubular main body 2 is of generally cylindrical form but with two inset channels 8 of approximately dovetail section at opposite sides. An external wall 10 closes each channel 8 at its lower end. The end wall 10 which is also of dovetail section is upwardly inclined and has a curved outer edge which corresponds to the curvature of the curved parts of the tubular body 2. A circular plate 12 at the top of the tubular body 2 is formed with an aperture 14 of a shape which corresponds to the internal cross-section of the tubular body 2. A removable cap 16 is fitted to the plate 12 and is retained within a peripheral lip thereof. For casting into the panel, the void former is set with its base on the casting bed, and following casting the cap 16 of the void former will be substantially flush with the upper surface of the cast panel.

Figure 3:
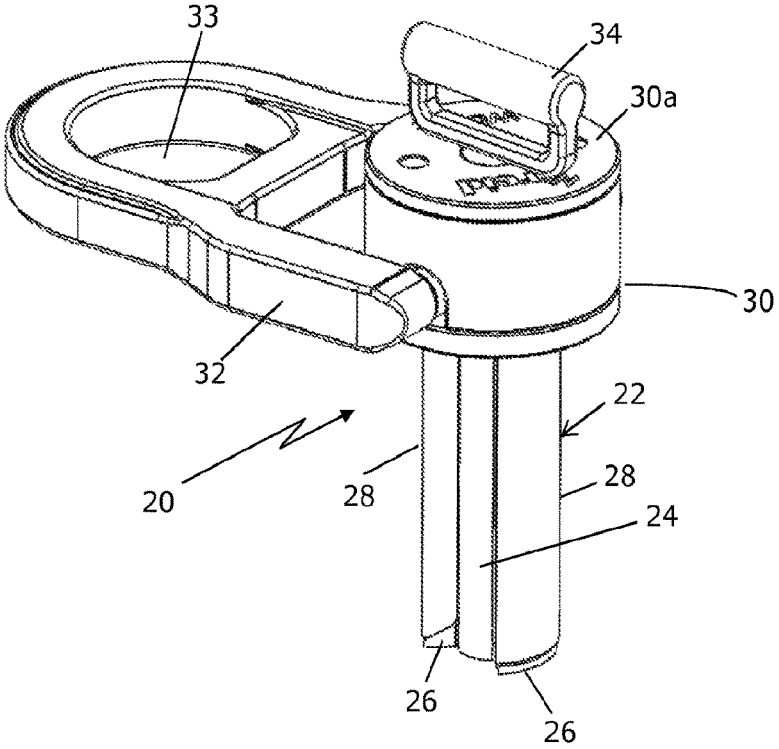
FIG. 3 shows a lifting anchor assembly engageable into a void formed by the void former assembly, the lifting anchor assembly being shown in a configuration in which a locking pin thereof is in a condition to enable insertion of a locking stem into the void.
Figure 4:
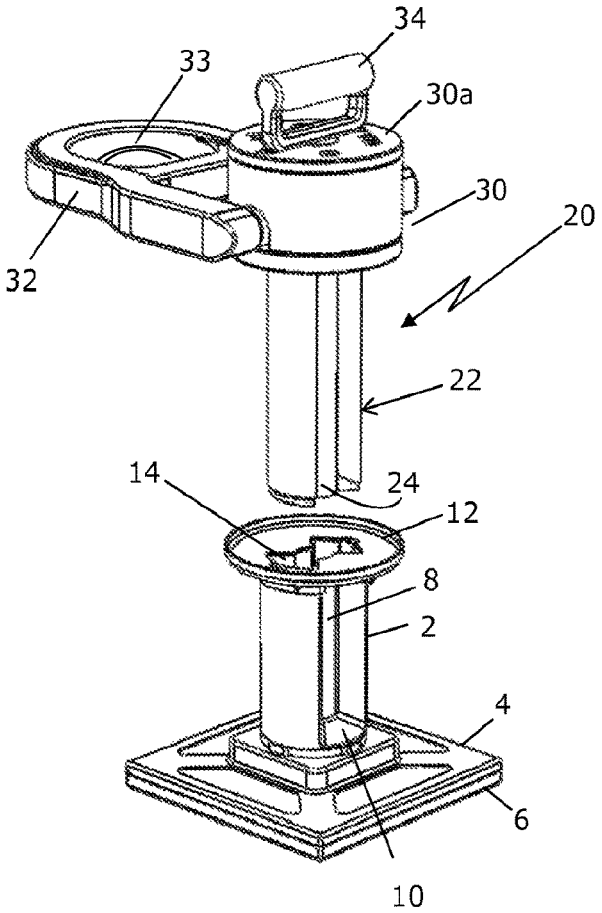
FIG. 4 shows the relation between the lifting anchor assembly and void former assembly for insertion of the locking stem.
Figure 5:
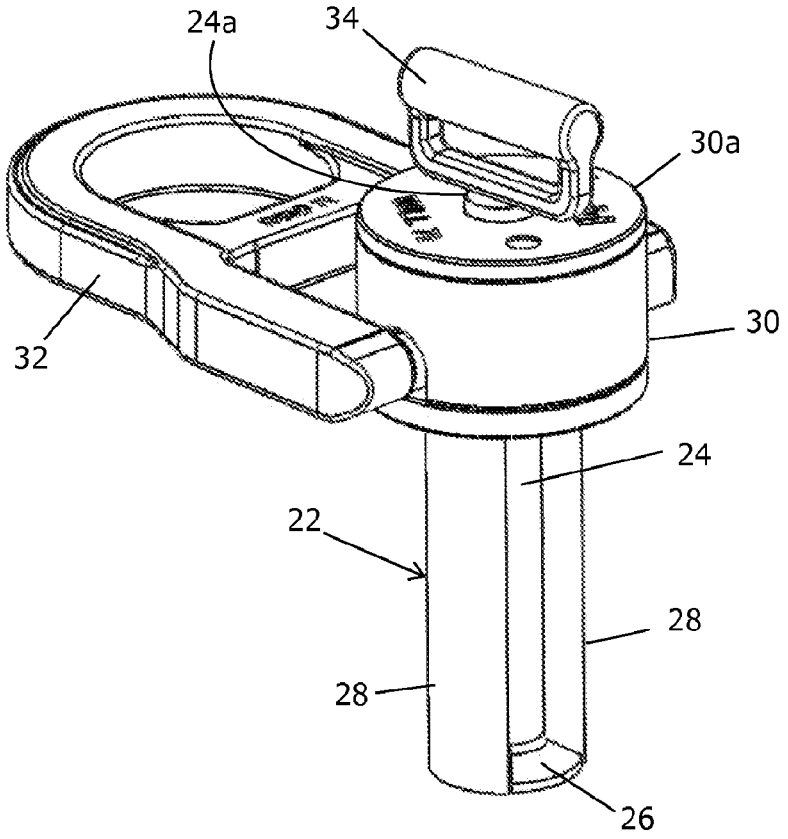
FIG. 5 shows the lifting anchor assembly in a condition in which the locking pin has been rotated to an engaged locking position.

With reference now to FIGS. 3 to 5 a lifting anchor assembly 20 comprises a main stem 22 which is engaged within the tubular body 2 of the void former after removal of the cap 16. The stem 22 includes a central rotatable locking pin 24 having at its lower end opposed outwardly extending locking lugs 26 of dovetail shape corresponding to that of the cross-section of the two channels 8 in the void former. The pin 24 is located between two fixed annular segments 28. It will be seen from the drawings that the overall configuration of the stem 22 formed by the rotary pin 24 and fixed outer segments 28 substantially corresponds to that of the tubular body 2 of the void former. As will be described in more detail below, the pin 24 is rotatable through 90 degrees from a position in which its locking lugs 26 are aligned with the segments 28 (see FIG. 3) whereby the stem 22 can be inserted into the interior of the void former via the aperture 14 in the plate 12 (see FIG. 4) and a locking position displaced through 90 degrees in which the locking lugs 26 are between the segments 28 (see FIG. 5).

Figure 6:
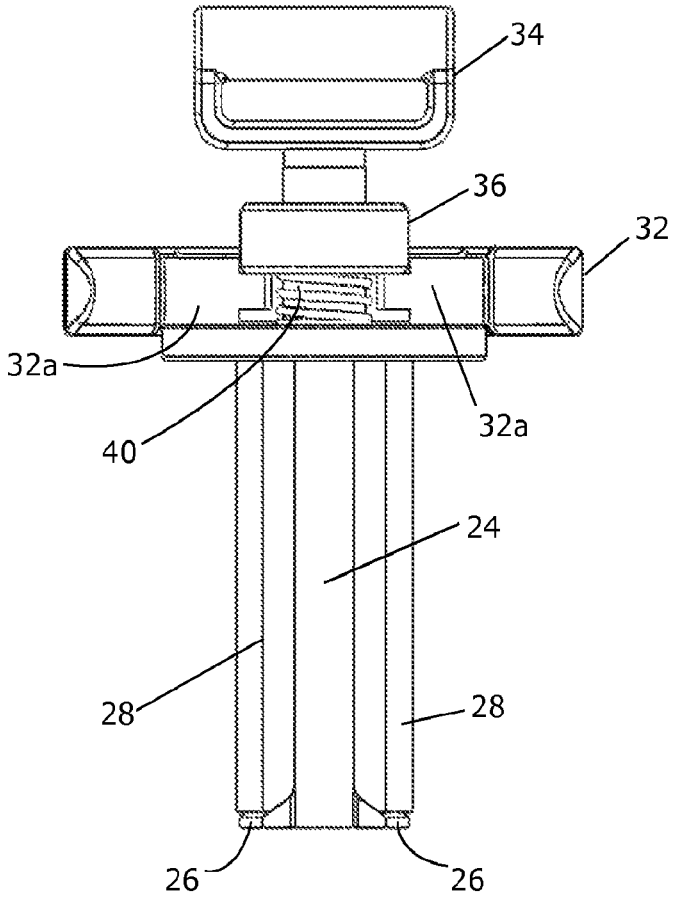
FIG. 6 shows the detailed structure of the lifting anchor assembly in the insertion conditions of FIGS. 3 and 4.
Figure 7:
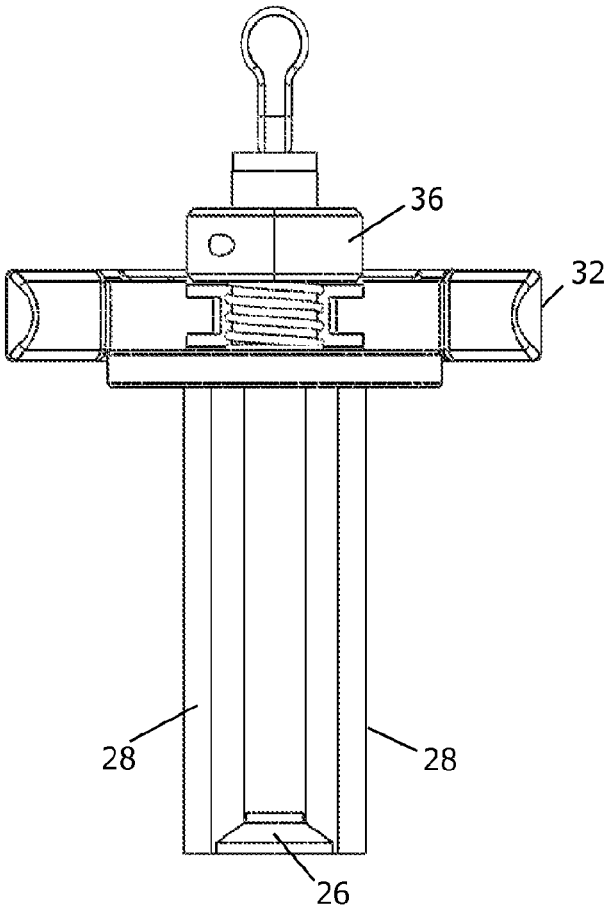
FIG. 7 shows the detailed structure of the lifting anchor assembly in the engaged locking condition of FIG. 5.

The main stem 22 is carried by an upper body 30 the lower edge of which sits within the circular plate 12 when the anchor is installed to the panel. A lifting shackle plate 32 with lifting eye 33 for coupling to a lifting clutch (not shown) is pivotally mounted to the body 30 for movement between an unlocked rotational position in which it extends generally horizontally and which is assumed during installation of the lifting anchor assembly into the panel, and a generally vertical locked position which it assumes during lifting. The detailed internal structure of the upper body 30 is shown in FIGS. 6 and 7 but with an external cover of the body omitted for clarity of illustration. As shown in these Figures, the fixed segments 28 of the main stem 22 are fixed to the body 30 and the locking pin 24 is rotatably mounted in the body 30 and is connected at its upper end to an upper handle 34. A locking collar 36 is mounted to an enlarged upper end of the locking pin 24 beneath the handle 34. A compression spring 40 mounted on the upper part of the locking pin 24 between a lower part of the upper body 30 and the collar 36 applies an upward bias to the locking pin 24 and hence to the handle 34 attached thereto.

When the locking pin 24 and its associated handle 34 are in the rotational unlocked position for insertion of the stem 22 into the void former, the locking lugs 26 are aligned with the fixed segments 28 and in that condition the locking pin 24 and its associated handle are in a lowered unlocked rotational position in which the locking lugs 26 are held against the lower edge of the segments 28 under the effect of the bias of the compression spring 40 (see FIG. 6). When, following insertion, the handle 34 is rotated through 90 degrees to pivot the pin 24 into its locking condition between the segments 28, under the effect of the compression spring 40, the pin 24 and associated handle 34 lift so that the locking lugs 26 will lie within the slots defined between the opposed edges of the two segments 28 whereby the pin is 24 positively locked by those edges against rotation out of that locking condition (see FIG. 7). The upwards movement which occurs to lock the pin is only a few millimeters and is limited by the configuration of the void former and in particular the lower end wall 10 of each of the two external channels 8. It is in this mode that lifting load can be applied.

Figure 6A:
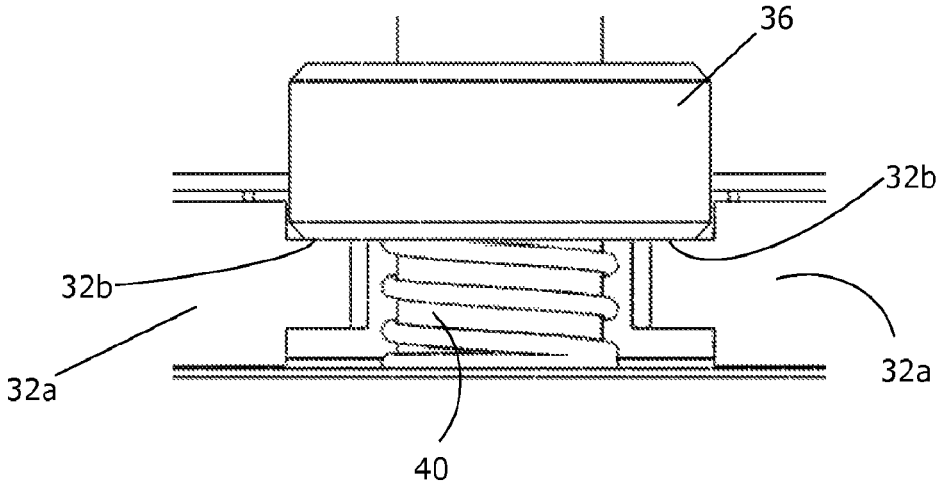
FIG. 6A shows an enlarged detail of FIG. 6.
Figure 7A:
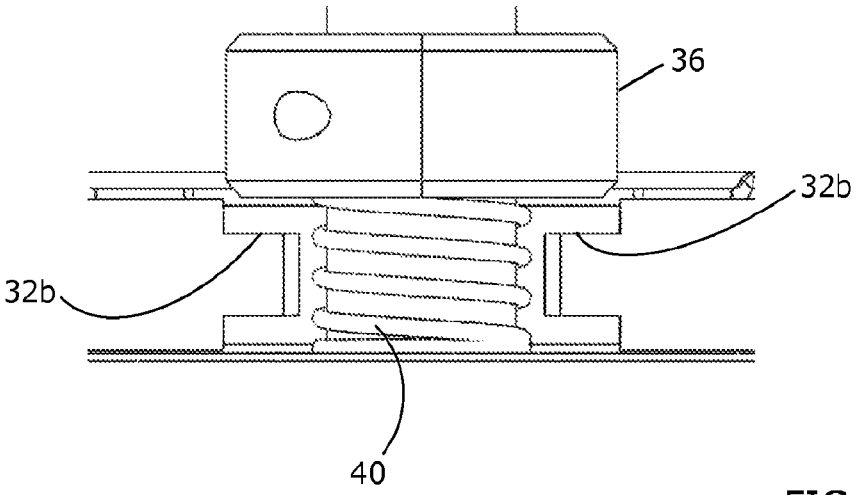
FIG. 7A shows an enlarged detail of FIG. 7.

The shackle plate 32 is journalled in the upper body 30 by lateral trunions 32*a*, the ends of which are shaped to define locking flats 32*b* as clearly shown in FIGS. 6 and 7. The locking flats 32*b* lie beneath the collar 36. The flats are so configured that in the unlocked rotational position of the pin 24 which it adopts for insertion into the void former and which is a lowered position of the pin, the locking flats 32*b* are engaged by the underside of the collar 36 whereby the lifting eye is locked by the collar in its horizontal configuration (see FIGS. 6 and 6A). In the locked condition of the locking pin 24 in which the pin and hence collar and handle are raised relative to the insertion position, the underside of the collar 36 is now raised clear of the locking flats 32*b* (see FIGS. 7 and 7A) whereby the shackle plate 32 can now be rotated into its generally vertical lifting configuration. This provides a significant safety feature as it ensures that the shackle plate cannot be moved to its lifting configuration unless the locking pin 24 is in its locked position or configuration.

Although identification as to whether the locking pin 24 is in its insertion or locked position can be visually attained by reference to the rotational position of the handle 34, certain embodiments of the present disclosure additionally incorporate an indicator readily visible from a more remote distance to particularly show that the pin it in its engaged locking condition. In the insertion unlocked rotational position the handle 34 lies relatively close to an upper cover 30*a* of the upper body 30 (see FIGS. 3 and 4). In the engaged locked position or locking condition, the handle 34 and adjacent section of the upper part of the pin 24 is raised relative to the upper cover 30*a* and that part 24*a* of the pin which is now exposed is coloured in a readily identifiable colour, such as green, to provide a further visual identification that the lifting system is in a locked condition within the panel and hence in a "safe" condition for lifting.

As mentioned previously, the base of the void former assembly also includes components of the jacking system used for leveling the panel after installation. A jacking plate 50, preferably a steel plate, is housed within a void within the two shells 4 and 6 of the base and is not exposed to the surrounding concrete after pouring. As such, the plate will be free to displace when jacking force is applied. The upper shell 4 also houses a threaded structure or nut 52 which is located above and adjacent to the jacking plate 50 in alignment with the axis of the tubular body 2 of the void former. After removal of the lifting anchor assembly following lowering of the panel into place within the roadway, a threaded jacking rod is inserted through the void former into engagement with the threaded structure or nut 52 and after only a few turns, perhaps just one or two turns, it will engage the jacking plate 50 to start raising the panel into its final leveled configuration. While this is fundamentally the same process as that previously described, it will be understood that whereas in the earlier arrangement in which the threaded insert extended substantially the full depth of the panel many turns of the jacking rod were required before the jacking action could commence, and subsequently many turns were required to remove the jacking rod after completion of the setting operation, with the incorporation of the threaded structure or nut 52 towards the lower end of the void former immediately adjacent the jacking plate that action can be accomplished much more quickly.

Although the embodiment typically described has been designed for the dual functions of providing a quick release lifting system combined with a jacking system also for quick release, an embodiment similar to that described but without the incorporation of the jacking system could provide a quick release lifting system for other precast concrete components when it is required to provide removable lifting anchors rather than cast-in lifting anchors as would typically be used in building construction involving the use of face lift or edge lift precast wall panels.

The embodiment has been described by way of example only and modifications are possible within the scope of the invention. More specifically, various changes and modifications to the above-described embodiments described herein will be apparent to those skilled in the art. These changes and modifications can be made without departing from the spirit and scope of this present subject matter and without diminishing its intended advantages. Not all of the depicted components described in this disclosure may be required, and some implementations may include additional, different, or fewer components from those expressly described in this disclosure. Variations in the arrangement and type of components; the shapes, sizes, and materials of the components; and the manners of attachment and connections of the components may be made without departing from the spirit or scope of the claims as set forth herein. Also, unless otherwise indicated, any directions referred to herein reflect the orientations of the components shown in the corresponding drawings and do not limit the scope of the present disclosure. This specification is intended to be taken as a whole and interpreted in accordance with the principles of the invention as taught herein and understood by one of ordinary skill in the art.

The claims defining the invention are as follows:

1. A lifting system for a concrete component, said lifting system comprising a void former positionable in the concrete component during casting of the concrete component, the void former defining a passage shaped to receive a locking stem of a lifting anchor assembly following casting of the void former in the concrete component, the passage defined by a tubular body having a lower end, the tubular body including an upwardly inclined end wall at the lower end of the tubular body, the void former positionable in the concrete component to define a void within the concrete component, the void shaped for locking engagement with a locking pin of the locking stem by rotation of the locking pin following insertion of the locking stem into the passage to lock the locking stem within the void to permit lifting load to be applied to the lifting anchor assembly, and the void former including a jacking plate and a threaded structure configured to threadably receive a threaded jacking rod inserted through the void former after removal of the lifting anchor assembly from the void filler to enable jacking of the concrete component relative to an underlying structure, wherein the jacking plate is movable relative to the concrete component during jacking of the concrete component.

2. The lifting system of claim 1, wherein the void former includes a base, and the threaded structure and the jacking plate are within the base.

3. A lifting system for a concrete component, said lifting system comprising:

a void former configured for incorporation into the concrete component during casting of the concrete component, the void former including:

a base;

a tubular body having a lower end coupled to the base, wherein an upwardly inclined end wall is attached to the lower end, the tubular body defining a passage configured to receive a locking stem of a lifting anchor assembly following casting of the void former in the concrete component, a jacking plate positioned below the tubular body; and a threaded structure positioned within the base and above the jacking plate, the threaded structure configured to threadably receive a threaded jacking rod inserted through the passage defined by the tubular body to enable jacking of the concrete component relative to an underlying structure.

4. The lifting system of claim 3, wherein the void former is positionable to define a void within the concrete component shaped for locking engagement with a locking pin of the locking stem by rotation of the locking pin following insertion of the locking stem into the passage to lock the locking stem within the void to permit lifting load to be applied to the lifting anchor assembly.

5. The lifting system of claim 3, wherein the tubular body is generally cylindrical and defines two inset channels.

6. The lifting system of claim 3, which includes a plate at the top of the tubular body, the plate defining an aperture having a shape corresponding to the passage.

7. The lifting system of claim 6, which includes a cap removably attached to the plate.

8. A lifting system for a concrete component, said lifting system comprising:

a void former positionable in the concrete component during casting of the concrete component, the void former including:

a base including an upper shell and a lower shell;

a tubular body having a lower end coupled to the base, the tubular body defining a passage configured to receive a locking stem of a lifting anchor assembly following casting of the void former in the concrete component;

a plate coupled to a top of the tubular body, the plate defining an aperture having a shape corresponding to the passage;

a jacking plate positioned within the upper shell and the lower shell; and a threaded structure positioned within the upper shell and lower shell above the jacking plate, the threaded structure configured to threadably receive a threaded jacking rod inserted through the passage defined by the tubular body to enable jacking of the concrete component relative to an underlying structure.

9. The lifting system of claim 8, wherein the void former defines a void within the concrete component shaped for locking engagement with a locking pin of the locking stem by rotation of the locking pin following insertion of the locking stem into the passage to lock the locking stem within the void to permit lifting load to be applied to the lifting anchor assembly.

10. The lifting system of claim 8, wherein the tubular body is generally cylindrical and defines two inset channels.

11. The lifting system of claim 10, which includes an end wall attached to a lower end of the tubular body.

12. The lifting system of claim 11, wherein part of the end wall is upwardly inclined.

13. The lifting system of claim 8, which includes a cap removably attached to the plate.

* * * * *